United States Patent [19]

Mangus et al.

[11] 4,054,400

[45] Oct. 18, 1977

[54] ENGINE PORT BRIDGING

[75] Inventors: Ervin E. Mangus, Brimfield; Alexander Goloff, East Peoria, both of Ill.

[73] Assignee: Caterpillar Tractor Co., Peoria, Ill.

[21] Appl. No.: 675,024

[22] Filed: Apr. 8, 1976

[51] Int. Cl.[2] ..... F04C 29/04

[52] U.S. Cl. ..... 418/83; 123/41.31

[58] Field of Search ..... 418/83, 61 A, 53; 123/8.01, 8.45, 41.31, 41.78; 165/52

[56] References Cited

U.S. PATENT DOCUMENTS

| | | | |
|---|---|---|---|
| 1,799,369 | 4/1931 | Herr | 123/41.31 |
| 3,448,727 | 6/1969 | Kobayakawa | 418/61 A |
| 3,485,218 | 12/1969 | Clarke | 418/53 |
| 3,954,356 | 5/1976 | Winchell et al. | 418/83 |

FOREIGN PATENT DOCUMENTS

| | | | |
|---|---|---|---|
| 928,075 | 6/1963 | United Kingdom | 123/8.01 |

*Primary Examiner*—William L. Freeh
*Assistant Examiner*—Leonard Smith
*Attorney, Agent, or Firm*—Wegner, Stellman, McCord, Wiles & Wood

[57] ABSTRACT

An internal combustion engine including a housing having interior walls defining an operating chamber, a piston mounted for movement within the chamber and carrying at least one seal for sealing against an interior wall, an output shaft associated with the piston and journalled in the housing, an exhaust port in one of the interior walls comprises of a series of openings extending through the wall into the chamber and spaced from one another by bridging elements forming part of the housing. Coolant passages are disposed at each of the bridging elements so that the same are cooled to maintain a good oil film at the exhaust port to minimize wear of the seal and to support the seal as it moves across the exhaust port.

9 Claims, 6 Drawing Figures

ENGINE PORT BRIDGING

BACKGROUND OF THE INVENTION

This invention relates to improved lubrication in internal combustion engines and, more particularly, to improving lubrication characteristics at exhaust ports in such engines.

Prior art of possible relevance includes U.S. Pat. No. 3,448,727 issued June 10, 1969 to Kobayakawa.

The use of bridging elements at exhaust ports in both reciprocating and rotary engines for supporting compression seals carried by reciprocating and rotary pistons for the purpose of reducing the unsupported span of the seal is highly desirable. However, the environment at such bridging is not at all conducive to the formation and maintenance of adequate oil films for lubricating the seals. Typically, the seals operate in the region of very thin oil film thickness known as elastohydrodynamic film lubrication or even boundary film lubrication. Thus, notwithstanding the use of expensive and sophisticated materials in the formation of the housings and seals in such mechanisms, the wear rate is frequently quite high.

At the bridging in engines, the exhaust gas termperatures are quite high and the bridging does not have a cooling down period during the induction stroke of the engine of any significant duration. Moreover, contact stresses with the seals are high because of the inevitable so-called "jumping" movement that the seal undergoes as it passes the port moving in and out of the same.

Heretofore, it has been thought impossible to cool the bridging adequately in such a way as to increase the thickness of the oil film and improve the maintenance of the same by reason of the bulk required to place cooling passes in such bridging, which is contradictory to good porting. In other words, the increased width of the bridging required to provide cooling passages therein interferes with good breathing characteristics of the engine, thereby reducing the efficiency of its operation.

SUMMARY OF THE INVENTION

It is the principal object of the invention to provide a new and improved internal combustion engine. More specifically, it is an object of the invention to provide such an engine with a bridged exhaust port of a construction wherein breathing characteristics are not interfered with and wherein the bridging elements are adequately cooled to maintain good oil films thereat conducive to the extension of seal life.

An exemplary embodiment of an internal combustion engine made according to the invention achieves the foregoing object in a structure including a housing having interior walls defining an operating chamber. A piston is mounted for movement within the chamber and carries at least one seal sealingly engaging an interior wall of the housing. An output shaft is operatively associated with the piston and is journalled within the housing. An exhaust port is located in an interior wall and is comprised of a series of openings extending through the wall into the chamber and spaced from one another by bridging elements forming part of the housing. Means defining coolant passages are disposed within each of the bridging elements so that the bridging elements are cooled to maintain a good oil film while they support the seal as it moves across the exhaust port.

According to one embodiment of the invention, the housing includes a casting defining an interior wall in which the exhaust port is disposed and the coolant passages comprise slots machined in the bridging elements and sealed by a wear resistant cap secured to the bridging elements.

According to another embodiment of the invention, the coolant passages are defined by at least one insert of thin, tubular construction and formed of high heat conductivity material. The insert has a surface coated with a thin layer of wear resistant material defining a portion of the one wall to be engaged by the seal.

According to either embodiment of the invention, the bridging elements have a surface contacted by the seal and at least some of the remaining surfaces of the bridging elements are provided with an insulating sheath.

In a highly preferred embodiment of the invention, the engine is a rotary engine and the piston is a rotary piston journalled on the shaft within the chamber. Preferably, the rotary engine is a slant axis rotary engine and the rotor is journalled on an angularly offset portion of the shaft. The wall including the port is a radially outer peripheral wall and the bridging elements extend generally parallel to the shaft.

According to any embodiment of the invention, the spacing between the bridging elements is varied with the spacing between the bridging elements contacted by the seal while subjected to relatively high pressures being less than the spacing between the bridging elements contacted by the seal when subjected to relatively lesser pressures.

According to one embodiment of the invention, an insert includes stamped, plural, interconnected, U-shaped troughs for conducting the coolant. The exterior surfaces of the bights of each trough are provided with a wear resistant coating and stiffener means are diposed in the peripheral ones of the troughs. A cover element is employed to seal each of the troughs.

Other objects and advantages will become apparent from the following specification taken in connection with the accompanying drawings.

DESCRIPTION OF THE PREFERRED EMBODIMENTS

Figure 1:
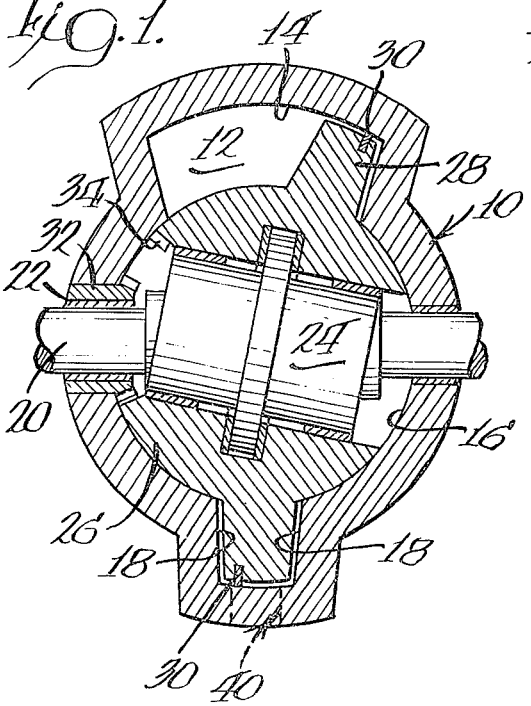
FIG. 1 is a sectional view of a slant axis rotary engine embodying the invention.

An exemplary embodiment of an internal combustion engine embodying the invention is illustrated in FIG. 1 in the form of a four-cycle, slant axis rotary engine. However, it is to be understood that the principles of the invention are applicable to engines operating on other than four cycles and engines other than slant axis rotary engines. For example, the invention can be employed usefully in reciprocating engines as well as other forms of rotary engines as trochoidan engines.

The engine includes a housing, generally designated 10, having interior walls defining an operating chamber 12. Specifically, the walls include a radially outer spherical wall 14, a radially inner spherical wall 16 and opposed, interconnecting end walls 18. A shaft 20 is journalled by bearings 22 in the housing and includes an angularly offset portion or eccentric 24 within the operating chamber 12 which journals a rotor 26. The rotor 26 includes a peripheral flange 28 of conventional construction which carries apex seals (not shown) which sealingly engage the side walls 18 and peripheral seals 30 which sealingly engage the radially outer spherical wall 14. Other seals are conventionally employed on the hub of the rotor 26. The basic organization is completed by a timing gear 32 carried by the housing 10 meshed with an internal ring gear 34 carried by the rotor 26.

Suitable intake and exhaust porting is provided, typically in the radially outer spherical wall 14, as illustrated generally at 40.

Figure 2:
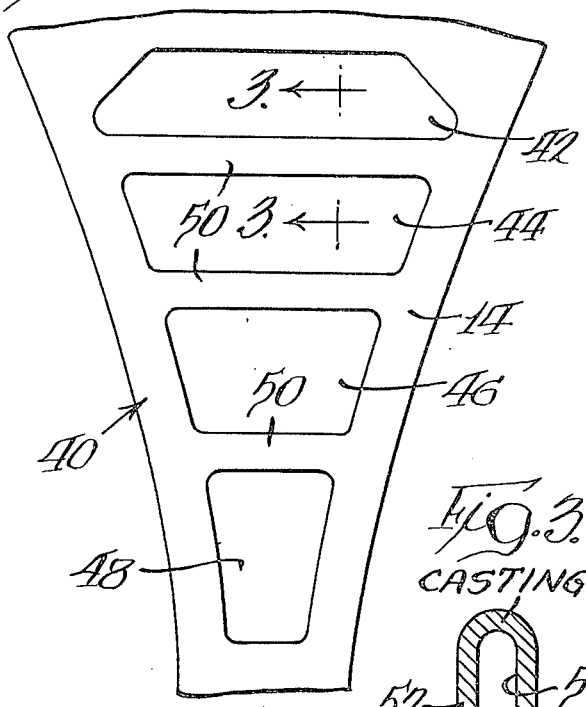
FIG. 2 is an enlarged, fragmentary, developed view of one embodiment of an exhaust port bridging structure made according to the invention.
Figure 3:
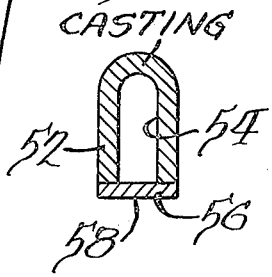
FIG. 3 is a further enlarged, sectional view taken approximately along the line 3—3 of FIG. 2.

Referring now to FIGS. 2 and 3, one form of the exhaust port 40 will be described in greater detail. Specifically, the exhaust port 40 is defined by plural openings 42, 44, 46 and 48 extending through the radially outer spherical wall 14 and separated from each other by bridging elements 50. As best seen in FIG. 3, each of the bridging elements 50 is part of a casting 52 forming part of the housing 10 and having a slot 54 milled or machined therein. The slot 54 opens towards the operating chamber 12 and in order to seal the same, a cap or cover 56 is secured to the same. The cap 56 will typically be formed of a wear resistant material and its surface 58 will be sealingly engaged by the seal 30 during operation. By reason of the cooling fluid going through the conduit defined by the slot 54 and the cap 56, the bridging elements 50 will be cooled so that a thick oil film will exist thereat notwithstanding hot gas adjacent thereto.

It will be noted that the spacing between the bridging elements 50 may be varied, as illustrated in FIG. 2, with the narrow spacing occurring relatively closer to the combustion zone and the wider spacing occurring relatively further from the combustion zone. The purpose of this construction is to maximize the good breathing characteristics of the engine without undesirably cutting back on the degree of support for the seals as they pass over the bridging. As is well known, the seals will typically be gas energized, that is, urged against the wall 14 by means of gas under pressure by reason of the pressure differential typically existing across the seal. When the seal first encounters the port, gas energizing pressure will be relatively high and there will be substantial force urging the seal into the openings, such as the openings 42 and 44. However, as the port opens further, the gas energizing pressure rapidly decays requiring less seal support. Consequently, the relatively narrow spacing of the bridging elements 50 nearest the combustion zone provides adequate support for the seals, while the relatively wider spacing in the relatively remote area improves the engine breathing characteristics.

Figure 4:
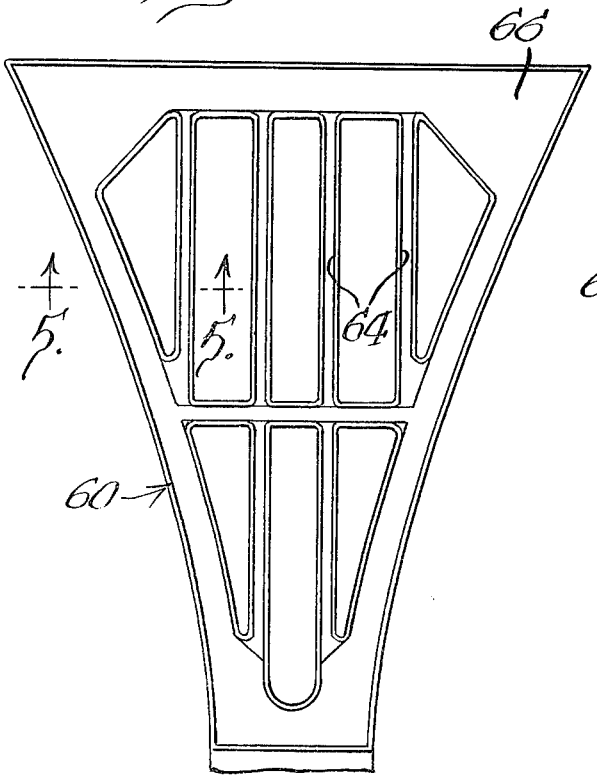
FIG. 4 is a view similar to that of FIG. 2 of a modified embodiment of the invention in a partially assembled state.
Figure 5:
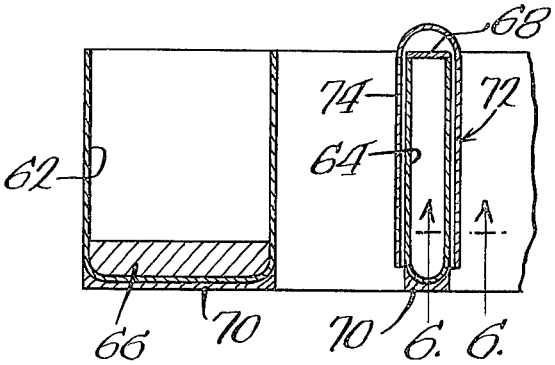
FIG. 5 is an enlarged, sectional view taken approximately along the line 5—5 of FIG. 4 with certain structure added.
Figure 6:
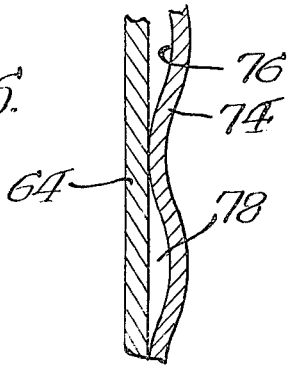
FIG. 6 is an enlarged, sectional view taken approximately along the line 6—6 of FIG. 5.

FIGS. 4–6 illustrate a modified embodiment of the invention wherein the port 40 is defined by a generally trapezoidal insert, generally designated 60. As illustrated in FIG. 4, the insert 60 is comprised in part by a stamping of relatively high heat conductivity material, as metal, such as brass or copper. More specifically, the metal is stamped to provide a series of upwardly opening, U-shaped troughs, as illustrated in FIG. 5, with a relatively wide trough 62 extending about the periphery of the insert 60 and the relatively narrower troughs 64 interconnecting each other and the peripheral troughs 62.

In general, the arrangement is not unlike that of the tubing employed in radiators for vehicle engines. As a consequence, the walls of the troughs 62 and 64 will typically have a thickness on the order of 0.2 mm and the structure will be relatively flimsy. Thus, for strengthening purposes, a stiffener 66 configured to fit in the peripheral troughs 62 to add rigidity is provided.

The assemblage may be completed by means of a complementary cap 68 (FIG. 5) suitably brazed or welded in place to close each of the troughs 64 as well as the troughs 62 (even though not shown in the drawings).

The exterior surface of the bight of each U-shaped trough 62 and 64 is provided with a wear resistant coating 70, as seen in FIG. 5. The coating may be nickel with chrome plate thereover and typically will be no thicker than about 0.2 mm. As a consequence, coolant flowing in the coolant passages defined by the troughs 64 passes within 0.4 mm of the oil film itself to thereby provide excellent cooling of the bridging elements defined by the bights of the troughs 64. In actuality, the oil film temperature will be very close to that of the coolant itself to ensure excellent lubrication.

To minimize undesirable heat rejection to the coolant, which might require the use of an oversized radiator in the cooling system, an insulating sheath, generally designated 72, is employed in connection with the various ones of the troughs. FIG. 5 shows the insulating sheath 72 in connection with a trough 64, but it is to be understood that it may be employed with the trough 62 as well as with the casting 52 used in the embodiment illustrated in FIGS. 2 and 3. Each sheath 72 consists essentially of an inverted, downwardly open, U-shaped metal element 74 provided with corrugated sides 76, as illustrated in FIG. 6. As a consequence, air spaces 78 are located between the sides of the element 74 and the sides of the troughs 64 to serve as an insulating area. The sheath 72 may be employed in connection with all surfaces of the bridging elements that are in nonrubbing relationship to the seals 30.

As will be appreciated, a variety of configurations of the bridging elements can be employed. In the embodiment illustrated in FIG. 2, the bridging elements 50 are parallel to the shaft 20 and thereby provide excellent support of the seals 30. However, if desired, a greater number of bridging elements may be circumferentially disposed with respect to the shaft 20, as is the case with the embodiments illustrated in FIG. 4.

In either event, support of the seals 30 as they pass over the exhaust port is provided in a structure wherein the oil film on the bridging elements providing such support is maintained at a relatively low temperature by reason of the coolant passing through passages within the briding elements.

What is claimed is:

1. An internal combustion engine, comprising:

a. a housing having interior walls defining an operating chamber;

b. a piston mounted for movement within said chamber and carrying at least one seal sealingly engaging an interior wall of said housing;

c. an output shaft operatively associated with said piston and journalled within said housing;
d. an exhaust port in said interior wall and comprised of a series of openings extending through said wall into said chamber and spaced from one another by at least one bridging element forming part of said housing;
e. means defining at least one coolant passage within each said bridging element; and
f. said bridging element and said coolant passage being defined by at least one insert in said housing about said port of thin, tubular construction of high heat conductivity material and having a surface coated with a thin layer of wear resistant material defining a portion of said one wall;
whereby said bridging element is cooled to maintain a good oil film at said exhaust port to minimize wear of said seal and said bridging element to support said seal as it moves across said exhaust port.

2. In an internal combustion engine, comprising:
a. a housing having interior walls defining an operating chamber;
b. a piston mounted for movement within said chamber and carrying at least one seal sealingly engaging an interior wall of said housing;
c. an output shaft operatively associated with said piston and journalled within said housing;
d. an exhaust port in said interior wall and comprised of a series of openings extending through said wall into said chamber and spaced from one another by at least one bridging element forming part of said housing;
e. means defining at least one coolant passage within each said bridging element; and
f. said bridging element having a surface contacted by said seal, at least some of the remaining surfaces of said bridging element being provided with an insulating sheath;
whereby said bridging element is cooled to maintain a good oil film at said exhaust port to minimize wear of said seal and said bridging element to support said seal as it moves across said exhaust port.

3. An internal combustion engine, comprising:
a. a housing having interior walls defining an operating chamber;
b. a piston mounted for movement within said chamber and carrying at least one seal sealingly engaging an interior wall of said housing;
c. an output shaft operatively associated with said piston and journalled within said housing;
d. an exhaust port in said interior wall and comprised of a series of openings extending through said wall into said chamber and spaced from one another by bridging elements forming part of said housing;
e. means defining coolant passages within each of said bridging elements; and
f. the spacing between said bridging elements being varied, the spacing between bridging elements contacted by said seal while relatively higher pressures are applied thereagainst being lesser than the spacing between bridging elements contacted by said seal when subjected to relatively lesser pressures;
whereby said bridging elements are cooled to maintain a good oil film at said exhaust port to minimize wear of said seal and said bridging elements to support said seal as it moves across said exhaust port.

4. An internal combustion engine, comprising:
a. a housing having interior walls defining an operating chamber;
b. a piston mounted for movement within said chamber and carrying at least one seal sealingly engaging an interior wall of said housing;
c. an output shaft operatively associated with said piston and journalled within said housing;
d. an exhaust port in said interior wall and comprised of a series of openings extending through said wall into said chamber and spaced from one another by bridging elements forming part of said housing; and
e. means defining coolant passages in said bridging elements;
f. one surface of each of said bridging elements being provided with wear resistant means for contact by said seal, at least one other surface of each said bridging element being provided with an insulating sheath.

5. The internal combustion engine of claim 4 wherein said engine is a rotary engine and said piston is a rotary piston journalled on said shaft within said chamber.

6. The internal combustion engine of claim 5 wherein said rotary engine is a slant axis rotary engine and said shaft has an angularly offset portion within said chamber and journaling said rotor; said one wall being a radially outer peripheral wall and said bridging elements being disposed generally parallel to said shaft.

7. An internal combustion engine, comprising:
a. a housing having interior walls defining an operating chamber;
b. a piston mounted for movement within said chamber and carrying at least one seal sealingly engaging an interior wall of said housing;
c. an output shaft operatively associated with said piston and journalled within said housing;
d. an exhaust port in said interior wall and comprised of a series of openings extending through said wall into said chamber and spaced from one another by bridging elements forming part of said housing; and
e. means defining coolant passages within each of said bridging elements including at least one insert assembly within said housing about said cort of thin walled, hilh heat conductivity metal, stamped to define plural, interconnected, U-shaped, coolant conducting troughs including peripheral troughs, the exterior surface of the bight of each trough being provided with a thin, wear resistant coating and defining a part of said interior wall, stiffener means in at least the peripheral ones of said troughs, and a cover sealing each of said troughs.

8. The internal combustion engine of claim 7 further including an insulating sheath surrounding each of said troughs save for said interior surface.

9. The internal combustion engine of claim 7 wherein at least one side surface of some of said troughs is provided with a corrugated metal sheath to define insulating air gaps.

* * * * *

UNITED STATES PATENT AND TRADEMARK OFFICE

CERTIFICATE OF CORRECTION

PATENT NO. : 4,054,400

DATED : October 18, 1977

INVENTOR(S) : Ervin E. Mangus and Alexander Goloff

It is certified that error appears in the above-identified patent and that said Letters Patent are hereby corrected as shown below:

Column 6, line 48, "cort" should read --port--;

Column 6, line 49, "hilh" should read --high--.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*